US005468603A

United States Patent [19]

Kub

[11] Patent Number: 5,468,603

[45] Date of Patent: Nov. 21, 1995

[54] PHOTOTHERMOGRAPHIC AND THERMOGRAPHIC ELEMENTS FOR USE IN AUTOMATED EQUIPMENT

[75] Inventor: Thomas J. Kub, West Lakeland Township, County of Washington, Minn.

[73] Assignee: Minnesota Mining and Manufacturing Company, Saint Paul, Minn.

[21] Appl. No.: 340,587

[22] Filed: Nov. 16, 1994

[51] Int. Cl.[6] ..... G03C 1/498

[52] U.S. Cl. ..... 430/619; 430/523; 430/533; 430/617; 430/631

[58] Field of Search ..... 430/619, 617, 430/523, 203, 531, 533, 535, 631, 271, 276, 525

[56] References Cited

U.S. PATENT DOCUMENTS

| | | | |
|---|---|---|---|
| 2,701,245 | 2/1955 | Lynn | 260/89.5 |
| 2,992,101 | 7/1961 | Jelley et al. | 96/23 |
| 3,457,075 | 7/1969 | Morgan et al. | 96/67 |
| 3,700,458 | 10/1972 | Lindhehn | 96/114.1 |
| 3,754,924 | 8/1973 | DeGeest et al. | 96/114.2 |
| 3,839,049 | 10/1974 | Simons | 96/114.6 |
| 4,076,539 | 2/1978 | Ikenoue et al. | 96/114.5 |
| 4,260,677 | 4/1981 | Winslow et al. | 430/618 |
| 4,425,425 | 1/1984 | Abbott et al. | 430/502 |
| 4,425,426 | 1/1984 | Abbott et al. | 430/502 |
| 4,806,461 | 2/1989 | Ikeda et al. | 430/567 |
| 4,869,955 | 9/1989 | Aschcraft et al. | 428/327 |
| 4,885,225 | 12/1989 | Heller et al. | 430/160 |
| 4,975,363 | 12/1990 | Cavallo et al. | 430/637 |
| 5,181,707 | 1/1993 | Takei et al. | 271/20 |
| 5,238,736 | 8/1993 | Tseng et al. | 428/327 |
| 5,258,261 | 11/1993 | Heller | 430/273 |
| 5,310,595 | 5/1994 | Ali et al. | 428/206 |
| 5,380,644 | 1/1995 | Yonkoski et al. | 430/617 |

*Primary Examiner*—Thorl Chea

*Attorney, Agent, or Firm*—Gary L. Griswold; Walter N. Kirn; Gregory A. Evearitt

[57] ABSTRACT

A photothermographic or thermographic imaging element having uniform optical density is described which is useful in automated equipment. A polymeric fluorinated surfactant is present in a layer adjacent to the photothermographic or thermographic emulsion layer to provide uniform optical density. Optically transparent polymeric beads are present in at least one outermost layer of the imaging element to assist in the separation and sliding of the elements when subjected to a film feeding mechanism in automated equipment.

6 Claims, No Drawings

PHOTOTHERMOGRAPHIC AND THERMOGRAPHIC ELEMENTS FOR USE IN AUTOMATED EQUIPMENT

BACKGROUND OF THE INVENTION

1. Field of the Invention

This invention relates to the use of optically transparent beads in photothermographic and thermographic elements having emulsion coatings of uniform optical density which are easily transported in an imaging apparatus.

2. Background of the Invention

The increasing availability and use of semiconductor light sources, such as laser diodes which emit in the visible and particularly in the red and infrared region of the electromagnetic spectrum, have led to the need for photothermographic and thermographic elements that have the ability to be efficiently exposed by laser imagesetters, light emitting diodes, or laser imagers and which have the ability to form sharp images of high resolution and sharpness. In addition, semiconductor light sources have allowed the design of compact automated equipment which increases the productivity of the imaging process, especially in medical diagnostic and graphic arts applications. The use of heat-developable elements eliminates the use of wet processing chemicals which provides a simpler, environmentally friendly system.

Silver halide-containing, photothermographic imaging materials (i.e., heat-developable photographic elements) processed with heat, and without liquid development, have been known in the art for many years. These materials are also known as "dry silver" compositions or emulsions and generally comprise a support having coated thereon: (1) a photosensitive material that generates silver atoms when irradiated; (2) a non-photosensitive, reducible silver source; (3) a reducing agent (i.e., a developer) for silver ion; and (4) a binder.

The photosensitive material is generally photographic silver halide which must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms (Ag°) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms (Ag°). The imagewise distribution of these clusters is known in the art as a latent image. This latent image is generally not visible by ordinary means. Thus, the photosensitive emulsion must be further processed to produce a visible image. This is accomplished by the reduction of silver ions which are in catalytic proximity to silver halide grains bearing the clusters of silver atoms, i.e., the latent image.

In a photothermographic element, the reducing agent for the organic silver salt, often referred to as a "developer," may be any material, preferably any organic material, that can reduce silver ion to metallic silver. At elevated temperatures, in the presence of the latent image, the non-photosensitive reducible silver source (e.g., silver behenate) is reduced by the reducing agent for silver ion. This produces a negative black-and-white image of elemental silver.

While conventional photographic developers such as methyl gallate, hydroquinone, substituted hydroquinones, hindered phenols, catechol, pyrogallol, ascorbic acid, and ascorbic acid derivatives are useful, they tend to result in very reactive photothermographic formulations and fog during preparation and coating of the photothermographic element. As a result, hindered bisphenol reducing agents have traditionally been preferred.

As the visible image in black-and-whim photothermographic elements is produced entirely by elemental silver (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents may be incorporated to improve the color of the silver image of the photothermographic element.

Another method of increasing the maximum image density in photographic and photothermographic emulsions without increasing the amount of silver in the emulsion layer is by incorporating dye-forming or dye-releasing materials in the emulsion. Upon imaging, the dye-forming or dye-releasing material is oxidized, and a dye and a reduced silver image are simultaneously formed in the exposed region. In this way, a dye-enhanced silver image can be produced.

The imaging arts have long recognized the fields of photothermography and thermography as being clearly distinct from that of photography. Photothermographic and thermographic elements significantly differ from conventional silver halide photographic elements which require wet-processing.

In photothermographic and thermographic imaging elements, a visible image is created by heat as a result of the reaction of a developer incorporated within the element. Heat is essential for development and temperatures of over 100° C. are routinely required. In contrast, conventional wet-processed photographic imaging elements require processing in aqueous processing baths to provide a visible image (e.g., developing and fixing baths) and development is usually performed at a more moderate temperature (e.g., 30°–50° C.).

In photothermographic elements only a small amount of silver halide is used to capture light and a different form of silver (e.g., silver behenate) is used to generate the image with heat. Thus, the silver halide serves as a catalyst for the development of the non-photosensitive, reducible silver source. In contrast, conventional wet-processed photographic elements use only one form of silver (e.g., silver halide) which, upon development, is converted to silver. Additionally, photothermographic elements require an amount of silver halide per unit area that is as little as one-hundredth of that used in a conventional wet-processed silver halide.

Photothermographic systems employ a light-insensitive silver salt, such as silver behenate, which participates with the developer in developing the latent image. In contrast, photographic systems do not employ a light-insensitive silver salt directly in the image-forming process. As a result, the image in photothermographic elements is produced primarily by reduction of the light-insensitive silver source (silver behenate) while the image in photographic black-and-white elements is produced primarily by the silver halide.

In photothermographic and thermographic elements, all of the "chemistry" of the system is incorporated within the element itself. For example, photothermographic and thermographic elements incorporate a developer (i.e., a reducing agent for the non-photosensitive reducible source of silver) within the element while conventional photographic elements do not. The incorporation of the developer into photothermographic elements can lead to increased formation of "fog" upon coating of photothermographic emulsions as compared to photographic emulsions. Even in so-called instant photography, developer chemistry is physically separated from the silver halide until development is desired. Much effort has gone into the preparation and manufacture of photothermographic and thermographic elements to minimize formation of fog upon coating, storage, and post-processing aging.

Similarly, in photothermographic elements, the unexposed silver halide inherently remains after development and the element must be stabilized against further development. In contrast, the silver halide is removed from photographic elements after development to prevent further imaging (i.e., the fixing step).

In photothermographic and thermographic elements the binder is capable of wide variation and a number of binders are useful in preparing these elements. In contrast, photographic elements are limited almost exclusively to hydrophilic colloidal binders such as gelatin.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.) which are intended to have a direct effect upon the imaging process can vary depending upon whether they have been incorporated in a photothermographic or thermographic element or incorporated in a photographic element.

Distinctions between photothermographic and photographic elements are described in *Imaging Processes and Materials* (*Neblette's Eighth Edition*), J. Sturge et al. Ed., Van Nostrand Reinhold, New York, 1989, Chapter 9 and in *Unconventional Imaging Processes,* E. Brinckman et at, Ed., The Focal Press, London and New York, 1978, pp. 74–75.

Thermographic imaging constructions (i.e., heat-developable materials) processed with heat, and without liquid development, are widely known in the imaging arts and rely on the use of heat to help produce an image. Upon heating, typically in the range of about 60°–225° C., a reaction occurs only in the heated areas resulting in the formation of an image.

Thermographic elements whose image-forming layers are based on silver salts of long chain fatty acids, such as silver behenate, are also known. These elements generally comprise a support or substrate (such as paper, plastics, metals, glass, and the like) having coated thereon: (1) a thermally-sensitive reducible silver source; (2) a reducing agent for the thermally-sensitive reducible silver source (i.e., a developer); and (3) a binder. Upon heating, silver behenate is reduced by a reducing agent for silver ion such as methyl gallate, hydroquinone, substituted-hydroquinones, hindered phenols, catechol, pyrogallol, ascorbic acid, ascorbic acid derivatives, leuco dyes, and the like, whereby an image comprised of elemental silver is formed.

Photothermographic and thermographic constructions are usually prepared by coating from solution and removing most of the coating solvent by drying. One common problem that exists with coating photothermographic systems is the formation of coating defects. Many of the defects and problems that occur in the final product can be attributed to structural changes within the coatings during the coating and drying processes. Among the problems that are known to occur during drying of polymeric film layers after coating is unevenness in the distribution of solid materials within the layer. Examples of specific types of coating defects encountered are "orange peel", "mottling", and "fisheyes". "Orange peel" is a fairly regular grainy surface that occurs on a dried, coated film usually because of the action of the solvent on the materials in the coating composition. "Fisheyes" are another type of coating problem, usually resulting from a separation of components during drying. There are pockets of different ingredients within the drying solution, and these pockets dry out into uneven coating anomalies. "Mottling" often occurs because of an unevenness in the removal of the solvent from the coating composition.

When a coating solution is dried at high speeds in an industrial oven, the resulting film often contains a motile pattern. This motile pattern is typically the result of surface tension gradients created by non-uniform drying conditions. Fluorochemical surfactants have been found to be particularly useful in coating applications to reduce mottle. When an appropriate fluorochemical surfactant is added to the coating solution, the surfactant holds the surface tension at a lower, but constant value. This results in a uniform film, free from mottle. Fluorochemical surfactants are used because organic solvents, such as 2-butanone (also known as methyl ethyl ketone or MEK), already have such low surface energies (24.9 dyne/cm) that hydrocarbon surfactants are ineffective. Copending U.S. patent application Ser. No. 08/104,888 (filed Aug. 10, 1993) describes the use of fluorochemical surfactants to reduce coating disuniformities such as motile, fisheyes and orange peel in photothermographic and thermographic elements. These fluorochemical surfactants are comprised of fluorinated terpolymers which are polymerization products of: (1) a fluorinated, ethylenically unsaturated monomer; (2) a hydroxyl-containing, ethylenically unsaturated monomer; and (3) a polar, ethylenically unsaturated monomer. The addition of these fluorochemical surfactants into the emulsion coatings gives rise to uniform optical densities which is highly desirable in medical diagnostic applications.

Since these fluorochemical surfactants act as surface active modifiers, the surface of the dried element has a slight tack due to the concentration of low molecular weight material at the surface. This tack may not present a problem when elements are manually removed from a container or cartridge; however, in an automated film-feeding apparatus the tack of the surface can Cause multi-films to be transported in the apparatus. The transportation of multiple films or elements can cause operational failure of the apparatus and can potentially damage internal mechanisms within the apparatus. At best, an operator has to open the apparatus to clear the jam, thereby resulting in loss of productivity which defeats the purpose of an automated system.

The addition of particulates, such as starch, titanium dioxide, zinc oxide, silica, and polyfluoroethylene polymeric beads are well known in the art as anti-blocking or slip agents. These types of particulates are translucent or opaque, thereby causing deteriorative effects on the image contrast.

The use of particulate matter in adhesive layers for anti-blocking characteristics is well known. A specific example of using organic polymeric beads with a narrow molecular weight distribution in an adhesive layer of a surprint color proof is described in U.S. Pat. No. 4,885,225. In this particular application, the size of the polymeric beads is kept small enough to become encapsulated into the adhesive when the proofing film is laminated to an opaque support; and thus, the beads have little or no effect on the visual properties of the final imaged proof.

The use of organic polymeric beads with a narrow molecular weight distribution in a protective layer of an overlap color proof is described in U.S. Pat. No. 5,258,261. The protective layer in this application is removed during the imaging process; and therefore, the beads would have no visual effect on the final image of the proof. Unlike liquid processed media that use polymeric beads in the topmost layer, photothermographic and thermographic elements typically do not remove the outermost layer in the imaging process.

The use of organic polymeric beads has also been shown to reduce the effects of Newton's rings when a film is contacted with reproduction media during the exposure process. A specific example of this application is described in U.S. Pat. No. 2,992,101.

Organic polymeric beads dispersed in a water-based receptive coating have also been shown to be useful in electrostatic transparencies imaged in plain paper copiers. Specific examples of this application is described in U.S. Pat. Nos. 5,310,595 and 4,869,955. In these applications the image is transferred onto the receptive layer containing the polymeric beads.

SUMMARY OF THE INVENTION

As explained earlier herein, whereas the use of fluorochemical surfactants reduces the formation of mottle in photothermographic and thermographic elements, they can present a problem because they also hamper the transportation of such elements in automated equipment. They can act as surface active modifiers, thereby resulting in the presence of a slight tack at the surface of a dried element due to the presence of low molecular weight material. This tack of the surface can cause operational failure of automated film-feeding apparatus because of the transportation of multiple films or elements.

In accordance with the present invention, however, it has now been discovered that the use of a plurality of optically transparent polymeric beads in at least one outermost layer of a photographic or thermographic element allows for the use of such fluorinated anti-motile agents without the attendant problems encountered in automated equipment. Quite surprisingly, the presence of the beads in at least one outermost layer of the photothermographic or thermographic element greatly assists in the separation and sliding of the element when subjected to a film feeding mechanism in automated equipment.

One embodiment of the present invention provides a photothermographic element comprising a support coated with: (1) a photothermographic emulsion layer comprising: (a) a photosensitive silver halide; (b) a non-photosensitive, reducible source of silver; (c) a reducing agent for the non-photosensitive, reducible source of silver; and (d) a binder; (2) a layer adjacent to the photothermographic emulsion layer comprising: (a) a binder; and (b) a polymeric fluorinated surfactant; and (3) at least one outermost layer comprising a plurality of optically transparent organic polymeric beads.

In photothermographic elements of the present invention, the layer(s) that contain the photosensitive silver halide, non-photosensitive, silver source material are referred to herein as photothermographic emulsion layer(s).

In an another embodiment, the present invention provides a thermographic element comprising a support coated with: (1) a thermographic emulsion layer comprising: (a) a non-photosensitive, reducible source of silver; (b) a reducing agent for the non-photosensitive, reducible source of silver; and (c) a binder; (2) a layer adjacent to the thermographic emulsion layer comprising: (a) a binder; and (b) a polymeric fluorinated surfactant; and (3) at least one outermost layer comprising a plurality of optically transparent organic polymeric beads.

In thermographic elements of the present invention, the layer(s) that contain the non-photosensitive, silver source material are referred to herein as thermographic emulsion layer(s).

Other aspects, advantages, and benefits of the present invention are apparent from the detailed description, examples, and claims.

DETAILED DESCRIPTION OF THE INVENTION

To date, photothermographic systems have not been useful for medical diagnostic or graphic arts laser recording purposes because of slow speed, low Dmax, poor contrast, poor optical density uniformity and insufficient sharpness at high Dmax. Copending U.S. patent applications Ser. Nos. 08/072,153 (filed Nov. 23, 1993) and 08/239,984 (filed May 9, 1994) describe most of the characteristics and attributes of a photothermographic element having, for example, an antihalation system, silver halide grains having an average particle size of less than 0.10 μm, and infrared supersensitization leading to an infrared photothermographic article reaching the requirements for medical or graphic arts laser recording applications.

In both the photothermographic and thermographic constructions, the polymeric fluorinated surfactant is present in a layer adjacent to the photothermographic or thermographic emulsion layer. An emulsion layer can be coated on both sides of a support if desired. The polymeric beads are present in at least one of the outermost layers in the construction. Non-limiting examples of outermost layers include topcoats, protective layers, antistatic layers, acutance layers, and antihalation layers. Preferably, the beads are located in the outermost layer on the opposite side of the support from the photothermographic or thermographic emulsion layer, herein referred to as a backside coating which is preferably an antihalation layer.

One of the advantages of adding a polymeric fluorinated surfactant, such as those described in copending U.S. patent application Ser. No. 08/104,888 (filed Aug. 10, 1993), is the uniformity of the coatings achieved. These fluorochemical surfactants are comprised of fluorinated terpolymers which are polymerization products of: (1) a fluorinated, ethylenically unsaturated monomer, (2) a hydroxyl-containing, ethylenically unsaturated monomer, and (3) a polar, ethylenically unsaturated monomer.

In the practice of the present invention, uniform coatings are those photothermographic or thermographic emulsion layer(s) on a transparent support, which when imaged with a flood light exposure at the wavelength of maximum sensitivity of the emulsion layer and uniformly thermally developed, provides an image which does not vary significantly in optical density from one exposed area (e.g., 1 square millimeter) to another by more than 5% in optical density units at an optical density of 1.0 with uniform backlighting of the imaged medium. This is particularly advantageous in high resolution systems, such as in medical diagnostic and graphic arts imaging applications.

To achieve the optimum coating uniformity, the polymeric fluorinated surfactant is preferably present in an amount of 0.05% to 10% and more preferably, from 0.1% to 1% by weight of the layer. As the concentration of the polymeric fluorinated surfactant is increased the coating uniformity increases; however, the surface tack also increases. As previously mentioned, surface tack causes multiple films to feed in a sheet feeding apparatus. In order to overcome this disadvantage and also maintain the optimum coating uniformity with the higher concentrations of fluorinated surfactants, a plurality of optically transparent polymeric beads are incorporated into the layer to reduce the effect of the tack by reducing the contact surface area.

The polymeric beads are present in a concentration sufficient to allow the films or elements to be separated from each other when subjected to a sheet pickup mechanism, such as the one described in U.S. Pat. No. 5,181,707. Alternatively, the films are also capable of easily sliding across each other when subjected to a feed mechanism which requires a single film to slide from a stack of films.

The separation or slip characteristics of the films are preferably improved by the incorporation of a plurality of optically transparent polymeric beads into at least one of the outermost layers of the film construction. The composition of the polymeric beads is chosen such that substantially all of the visible wavelengths (400 nm to 700 nm) are transmitted through the material to provide optical transparency. Non-limiting examples of polymeric beads that have excellent optical transparency include polymethylmethacrylate and polystyrene methacrylate beads, described in U.S. Pat. No. 2,701,245; and beads comprising diol dimethacrylate homopolymers or copolymers of these diol dimethacrylates with long chain fatty alcohol esters of methacrylic acid and/or ethylenically unsaturated comonomers, such as stearyl methacrylate/hexanediol diacrylate crosslinked beads, as described in U.S. Pat. Nos. 5,238,736 and 5,310,595.

Even though the polymeric beads are optically transparent, haze can be introduced into the photothermographic and thermographic elements depending upon the shape, surface characteristics, concentration, size, and size distribution of the beads. The smoothness of the bead surface and shape of the bead are chosen such that the amount of reflected visible wavelengths (400 nm to 700 nm) of light is kept to a minimum. The shape of the beads is preferably spherical, oblong, ovoid, or elliptical. The particle diameter is preferably in a size range of 1–12 μm in average size; more preferably, 1.5 to 10 μm in average size; and most preferably, 2–9 μm in average size, particularly with fewer than 25% of the total number of beads being outside a range of ±15% of the average size of the beads. In some constructions, it is advantageous to add two distinct set of beads with different average sizes. This allows the flexibility to balance haze with slip or separation characteristics. The beads may be present on the surface from about 50 to 500 beads per square millimeter; more preferably, 75 to 400 beads per square millimeter; and most preferably, 100 to 300 beads per square millimeter. The increase in percent haze due to the introduction of the beads into the construction is preferably no more than 15%; more preferably no more than 8%; and most preferably no more than 6%.

The optically transparent organic polymeric beads which alter the separation or slip characteristics of the element's surface are provided in the imaging layers in such a manner that they tend to protrude from the surface of the outermost layer. Non-limiting examples of outermost layers include topcoats, protective layers, antistatic layers, acutance layers and antihalation layers. The thickness of the outermost layers in a photothermographic or thermographic element according to the present invention are typically on the order of 10 to 40 μm for a single layer construction and 0.5 to 6 μm for a topcoat or backside layer in a multi-layer construction.

The Photosensitive Silver Halide

As noted above, when used in a photothermographic element the present invention includes a photosensitive silver halide in the photothermographic construction. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The silver halide may be in any form which is photosensitive including, but not limited to cubic, octahedral, rhombic dodecahedral, orthrohombic, tetrahedral, other polyhedral habits, etc., and may have epitaxial growth of crystals thereon. Tabular grains are not prefered and are in fact least prefered crystal habits to be used in the photothermographic elements of the present invention. Narrow grain size distributions of truly tabular grains (e.g., with aspect ratios of 5:1 and greater) can not be readily provided by existing techniques with the prefered grain sizes of less than an average diamater size of 0.10 μm. There are grains refered to in the art as "tabular," "laminar," or "sigma" grains which may have aspect ratios of less than 5:1, such as disclosed in U.S. Pat. No. 4,806,461 which shows "tabular" twinned plane grains called laminar grains with aspect ratios equal to or greater than 2:1 with grain thickness of less than 0.5 μm and grain diameter averages of less than 0.3, but it is not clear that such grains are within the consideration of the ordinarily skilled artisan as laminar or tabular grains as much as they are merely definitions broadening the coverage of the terms without the conceptual benefits of the original disclosures of tabular grains in providing higher capture surface areas to volume ratios for the silver halide grains (e.g., higher projected areas per coating weight of grains as in U.S. Pat. Nos. 4,425,425 and 4,425,426).

The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio. Core-shell type silver halide grains useful in photothermographic elements and methods of preparing these materials are described in allowed copending U.S. patent application Ser. No. 08/199,114 (filed Feb. 22, 1994). A coreshell silver halide grain having an iridium doped core is particularly preferred. Iridium doped core-shell grains of this type are described in copending U.S. patent application Ser. No. 08/239,984 (filed May 9, 1994).

The silver halide may be prepared ex situ, (i.e., be pre-formed) and mixed with the organic silver salt in a binder prior to use to prepare a coating solution. The silver halide may be pre-formed by any means, e.g., in accordance with U.S. Pat. No. 3,839,049. For example, it is effective to blend the silver halide and organic silver salt using a homogenizer for a long period of time. Materials of this type are often referred to as "pre-formed emulsions." Methods of preparing these silver halide and organic silver salts and manners of blending them are described in *Research Disclosure,* Jun. 1978, item 17029; U.S. Pat. Nos. 3,700,458 and 4,076,539; and Japanese patent application Nos. 13224/74, 42529/76, and 17216/75.

It is desirable in the practice of this invention to use pre-formed silver halide grains of less than 0.10 μm in an infrared sensitized, photothermographic material. Preferably the number average particle size of the grains is between 0.01 and 0.08 μm; more preferably, between 0.03 and 0.07 μm; and most preferably, between 0.04 and 0.06 μm. It is also prefered to use iridium doped silver halide grains and iridium doped core-shell silver halide grains as disclosed in copending U.S. patent application Ser. Nos. 08/072,153, and 08/239,984 described above.

Pre-formed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mol to about 0.5 mol; preferably, from about 0.01 mol to about 0.15 mol per mol; and more preferably, from 0.03 mol to 0.12 mol per mol of non-photosensitive reducible silver salt.

The silver halide used in the present invention may be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James *The Theory of the Photographic Process,* Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

Addition of sensitizing dyes to the photosensitive silver halides serves to provide them with high sensitivity to visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally about $10^{-10}$ to $10^{-1}$ mol; and preferably, about $10^{-8}$ to $10^{-3}$ mols per mol of silver halide.

Supersensitizers

To get the speed of the photothermographic elements up to maximum levels and further enhance infrared sensitivity, it is often desirable to use supersensitizers. Any supersensitizer can be used which increases the infrared sensitivity, but preferred supersensitizers are described in copending U.S. patent application Ser. No. 07/846,919 and include heteroaromatic mercapto compounds (I) or heteroaromatic disulfide compounds (II)

Ar—SM (I)

Ar—S—S—Ar (II)

wherein M represents a hydrogen atom or an alkali metal atom.

In supersensitizers (I) and (II), Ar represents an aromatic ring or fused aromatic ring containing one or more of nitrogen, sulfur, oxygen, selenium or tellurium atoms. Preferably, the heteroaromatic ring is benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. However, other heteroaromatic rings are envisioned under the breadth of this invention.

The heteroaromatic ring may also carry substituents with examples of preferred substituents being selected from the class consisting of halogen (e.g., Br and Cl), hydroxy, amino, carboxy, alkyl (e.g. of 1 or more carbon atoms, preferably 1 to 4 carbon atoms) and alkoxy (e.g. of 1 or more carbon atoms, preferably of 1 to 4 carbon atoms.

The preferred supersensitizers are 2-mercaptobenzimidazole, 2-mercapto-5-methylbenzimidazole and 2-mercaptobenzothiazole.

The supersensitizers are used in general amount of at least 0.001 mol/mol of silver in the emulsion layer. Usually the range is between 0.001 and 1.0 mol of the compound per mol of silver and preferably between 0.01 and 0.3 mol of compound per mol of silver.

The Non-Photosensitive Reducible Silver Source Material

When used in photothermographic and thermographic constructions the non-photosensitive reducible silver source used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido)benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzylthio-1,2,4-thiazole; and a silver salt of a thione compound, such as a silver salt of 3-(2-carboxyethyl)-4-methyl-4-thiazoline-2-thione as disclosed in U.S. Pat. No. 3,201,678.

Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet materials made on transparent film backing require a transparent coating. For this purpose a silver behenate full soap, containing not more than about 4 or 5 percent of free behenic acid and analyzing about 25.2 percent silver, can be used.

The method used for making silver soap dispersions is well known in the art and is disclosed in *Research Disclosure,* April 1983, item 22812, *Research Disclosure,* October 1983, item 23419, and U.S. Pat. No. 3,985,565.

The silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing pre-formed silver halide in accordance with this invention can be sensitized with chemical sensitizers, or with spectral sensitizers as described above.

The source of reducible silver material generally constitutes about 5 to about 70 percent by weight of the emulsion layer. It is preferably present at a level of about 10 to about 50 percent by weight of the emulsion layer.

The Reducing Agent for the Non-Photosensitive Reducible Silver Source

When used in black-and-white photothermographic and thermographic constructions, the reducing agent for the organic silver salt may be any material, preferably organic material, that can reduce silver ion to metallic silver. Conventional photographic developers such as phenidone, hydroquinones, and catechol are useful, but hindered bisphenol reducing agents are preferred.

When the photothermographic element used in this invention containing a reducing agent for the non-photosensitive reducible silver source is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image is obtained either in exposed areas or in unexposed areas with exposed photosensitive silver halide.

A wide range of reducing agents has been disclosed in dry silver systems including amidoximes, such as phenylamidoxime, 2-thienylamidoxime and p-phenoxy-phenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; bisphenols, such as bis(2-hydroxy-3-t-butyl-5-methylphenyl)methane, 1,1-bis(2-hydroxy-3,5-dimethylphenyl)- 3,5,5-trimethylhexane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane; ascorbic acid derivatives, such as 1-ascorbylpalmitate, ascorbyl-stearate; unsaturated aldehydes and ketones; certain 1,3-indanediones, and 3-pyrazolidones (phenidones).

The reducing agent should be present as 1 to 10% by weight of the imaging layer. In multilayer constructions, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

When the photothermographic element used in this invention containing an optional dye-forming or dye-releasing material is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a dye image is obtained simultaneously with the formation of a silver image either in exposed areas or in unexposed areas with exposed photosensitive silver halide.

Leuco dyes are one class of dye-forming material that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenic leuco dyes, such as indoaniline, indophenol, or azomethine leuco dyes; imidazole leuco dyes, such as 2-(3,5-di-t-butyl-4-hydroxyphenyl)- 4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

Another preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, *The Chemistry of Synthetic Dyes,* Academic Press: New York, 1952; Vol. 4, Chapter VI.

Another class of leuco dyes useful in this invention are "aldazine" and "ketazine" leuco dyes. Dyes of this type are described in U.S. Pat. Nos. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as pre-formed-dye-release (PDR) or redox-dye-release (RDR) materials. In these materials, the reducing agent for the organic silver compound releases a mobile pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent Application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 weight percent, and more preferably, in the range of 1–10 weight percent, based upon the total weight of each individual layer in which the reducing agent is employed.

The Binder

The photosensitive silver halide (when used), the non-photosensitive reducible source of silver, the reducing agent, and any other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as polyvinyl butyral and polyvinyl formal, and vinyl copolymers such as polyvinyl acetate and poly(vinyl chloride are particularly preferred.

Although the binder can be hydrophilic or hydrophobic, preferably it is hydrophobic in the silver containing layer(s). Optionally, these polymers may be used in combination of two or more thereof.

The binders are preferably used at a level of about 30–90 percent by weight of the emulsion layer, and more preferably at a level of about 45–85 percent by weight. Where the proportions and activities of the reducing agent for the non-photosensitive reducible source of silver require a particular developing time and temperature, the binder should be able to withstand those conditions. Generally, it is preferred that the binder not decompose or lose its structural integrity at 250° F. (121 ° C.) for 60 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic and thermographic emulsion layer can be prepared by dissolving and dispersing the binder; the photosensitive silver halide (when used); the non-photosensitive, reducible silver source; the reducing agent for the non-photosensitive reducible silver source (as, for example, the optional leuco dye); the fluorinated polymer of this invention; and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10 percent by weight of the emulsion layer, preferably about 0.1–10 percent by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4-thiazolidinedione; naphthalimides, such as N-hydroxy-1,8-naphthalimide; cobalt complexes, such as cobaltic hexamine trifluoroacetate; mercaptans such as 3 -mercapto-1,2,4-triazole, 2,4-dimercaptopyrimidine, 3-mercapto-4,5-diphenyl- 1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photo-bleach agents, such as a combination of N,N'-hexamethylene-bis(1-carbamoyl- 3,5-dimethylpyrazole), 1,8-(3,6-diazaoctane)bis(isothiuronium)trifluoroacetate, and 2-(tribromomethylsulfonyl benzothiazole); merocyanine dyes such as 3-ethyl- 5-[(3-ethyl-2-benzothiazolinylidene)-1-methyl-ethylidene]-2-thio- 2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl- 1,3-benzoxazine-2,4-dione, and 6-nitro-1,3-benzoxazine-2,4-dione; pyrimidines and asym-triazines, such as 2,4-dihydroxypyrimidine, 2-hydroxy-4-aminopyrimidine, and azauracil; and tetrazapentalene derivatives, such as 3,6-dimercapto-1,4-diphenyl-1H, 4H-2,3a,5,6a-tetraazapentalene and 1,4-di-(o-chlorophenyl)-3,6-dimercapto-1H, 4H-2,3a,5,6a-tetraazapentalene.

When used in photothermographic elements the photothermographic elements can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,131,038 and U.S. Pat. No. 2,694,716; the azaindenes described in U.S. Pat. Nos. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Photothermographic and thermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

The photothermographic and thermographic elements of the present invention can also include image dye stabilizers. Such image dye stabilizers are illustrated by U.K. Patent No. 1,326,889; and U.S. Pat. Nos. 3,432,300; 3,698,909; 3,574,627; 3,573,050; 3,764,337; and 4,042,394.

The photothermographic and thermographic elements can further contain inorganic or organic hardeners. When used with hydrophilic binders, it is possible to use chromium salts such as chromium alum, chromium acetate, etc.; aldehydes such as formaldehyde, glyoxal, glutaraldehyde, etc.; N-methylol compounds such as dimethylolurea, methylol dimethyl-hydantoin, etc.; dioxane derivatives such as 2,3-dihydroxydioxane, etc.; active vinyl compounds such as 1,3,5-triacryloyl-hexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, and mucophenoxychloric acid, etc.; which may be used individually or as a combination thereof. When used with hydrophobic binders, it is possible to use compounds such as poly-isocyanates, epoxy resins, melamines, phenolic resins, and dialdehydes as harderners.

Photothermographic elements according to the present invention can further contain light-absorbing materials, antihalation, acutance, and filter dyes such as those described in U.S. Pat. Nos. 3,253,921; 2,274,782; 2,527,583; 2,956,879, 5,266,452, and 5,314,795. If desired, the dyes can be mordanted, for example, as described in U.S. Pat. No. 3,282,699.

Photothermographic and Thermographic Constructions

The photothermographic and thermographic elements of of this invention may be constructed of one or more layers on a support. Single layer constructions should contain the silver halide (when used), non-photosensitive reducible silver source, he reducing agent for silver ion (i.e., the developer), binder, polymeric fluorinated surfactant, and optically transparent polymeric beads as well as optional materials such as toners, coating aids, leuco dyes, and other adjuvants.

Two-layer constructions should contain silver halide and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned. The optically transparent polymeric beads are preferably present in the outermost layer of the construction. Multicolor photothermographic constructions may contain sets of these bilayers for each color or they may contain all ingredients within a single layer as described in U.S. Pat. No. 4,708,928. In the case of multilayer, multicolor photothermographic articles, the various emulsion layers are generally maintained distinct from each other by the use of functional or non-functional barrier layers between the various photosensitive layers as described in U.S. Pat. No. 4,460,681.

The photothermographic dry silver emulsions can be coated on the support by any suitable "simultaneous wet-on-wet" coating procedure such as by multi-knife coating; multi-roll coating; multi-slot coating; multi-slide coating; and multi-curtain coating.

The coating amount of the photothermographic or thermographic emulsion layer used in the present invention is from 10 g/m$^2$ to 30 g/m$^2$; and preferably, from 18 g/m$^2$ to 22 g/m$^2$.

The coated constructions can be dried using any suitable method such as, for example, by using an oven; countercurrent parallel air flow; impingement air; infrared light; radiant heating; microwave; or heated rollers.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica. Alternatively, the formulation can be spray-dried or encapsulated to produce solid particles, which can then be redispersed in a second, possibly different, binder and then coated onto the support. The formulation for the emulsion layer can also include coating aids such as fluoroaliphatic polyesters.

Additionally, it may be desirable in some instances to coat different emulsion layers on both sides of a transparent support, especially when it is desirable to isolate the imaging chemistries of the different emulsion layers as disclosed in U.S. Pat. No. 5,264,321.

Development conditions will vary depending on the construction used, but will typically involve heating the imagewise exposed material at a suitably elevated temperature, e.g. from about 80° C. to about 250° C.; preferably, from about 120° C. to about 200° C., for a sufficient period of time, generally from 1 second to 2 minutes.

When used in a thermographic element, the image may be developed merely by heating at the above noted temperatures using a thermal stylus, print head, laser beam, or by heating while in contact with a heat absorbing material.

The Support

Photothermographic and thermographic emulsions used in the invention can be coated on a wide variety of supports. The support, or substrate, can be selected from a wide range of materials depending on the imaging requirement. Supports may be transparent or at least translucent. Typical supports include polyester film, subbed polyester film (e.g., polyethylene terephthalate or polyethylene naphthalate film), cellulose acetate film, cellulose ester film, polyvinyl acetal film, polyolefinic film (e.g., polethylene or polypropylene or blends thereof), polycarbonate film and related or resinous materials, as well as glass, paper, and the like. Typically, a flexible support is employed, especially a polymeric film support, which can be partially acetylated or coated, particularly with a polymeric subbing or priming agent. Preferred polymeric materials for the support include polymers having good heat stability, such as polyesters. Particularly preferred polyesters are poly(ethylene terephthalate) and poly(ethylene naphthalate).

A support with a backside resistive heating layer can also be used photothermographic imaging systems such as shown in U.S. Pat. No. 4,374,921.

Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources such as Aldrich Chemical Co. (Milwaukee, Wis.), unless otherwise specified.

The polystyrene methacrylate and methyl methacrylate optically transparent beads were prepared as described in U.S. Pat. No. 2,701,245.

Butvar™ B-79 is a poly(vinyl butyral) available from Monsanto Company, St. Louis, Mo.

Desmodur™ N3300 is an aliphatic triisocyanate available from Mobay Chemical Co., Pittsburgh, Pa.

Permanax WSO is 1,1-bis(2-hydroxy-3,5-dimethylphenyl)-3,5,5-trimethylhexane [CAS RN=7292-14-0](available from Vulnax International Ltd.) It is also known as Nonox.

PE-2200 is a polyester resin available from Shell Oil Co., Akron, Ohio.

Acryloid™ A-21 is an acrylic copolymer available from Rohm and Haas, Philadelphia, Pa.

MEK is methyl ethyl ketone (2-butanone).

PET is poly(ethylene terephthalate).

Dye-1 has the following structure and is disclosed in copending U.S. patent application Ser. No. 08/202,941 (filed Feb. 28, 1994).

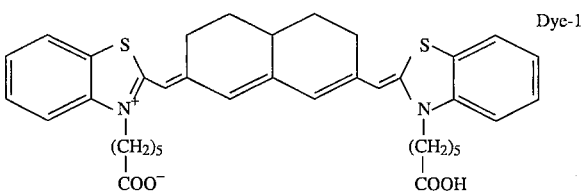

Dye-1

2-(Tribromomethylsulfonyl)quinoline has the following structure:

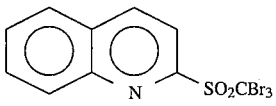

The polymeric fluorinated surfactant A has the following random polymer structure, where m=7, n=2 and p=1. The preparation of polymeric fluorinated surfactant A is described in copending U.S. patent application Ser. No. 08/104,888 (filed August 10, 1993).

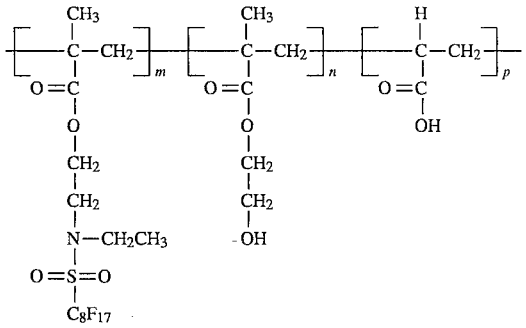

The antihalation Dye-2 has the following structure. The preparation of the antihalation Dye-2 is described in Example 1f of copending U.S. patent application Ser. No. 08/203,120 (filed Feb. 28, 1994).

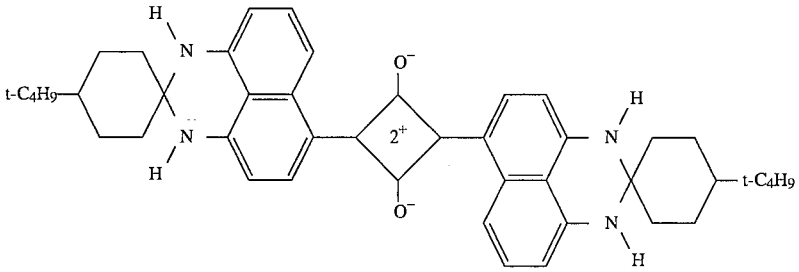

Dye-2

Vinyl Sulfone is described in European Laid Open Patent Application No. 0 600 589 A2 and has the following structure:

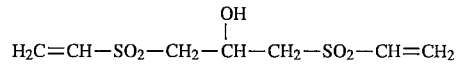

Antistat L has the following structure and can be prepared using the general procedure described in U.S. Pat. No. 4,975,363:

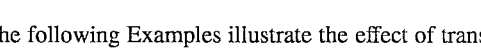

The following Examples illustrate the effect of transportability and image uniformity by incorporating the polymeric fluorinated surfactant and optically transparent beads in a photothermographic element. The core-shell silver iodobromide emulsion, iridium-doped preformed silver soap dispersion, homogenate, and photothermographic silver emulsion coating solution described below were used in the preparation of Examples 1–4:

Preparation of Core-Shell Silver Iodobromide Emulsion:

A solution was prepared by mixing the following ingredients while holding the temperature between 30°–38° C.

| | |
|---|---|
| Phthalated gelation | 50 g |
| Deionized Water | 1500 mL |
| Potassium Bromide (0.1M) | 6 mL |

The pH of the solution was adjusted to 5.0 with 3N nitric acid. The following aqueous potassium salt and silver nitrate solutions were prepared at 25° C. and jetted into the solution described above over a 9.5 minutes time interval.

| | |
|---|---|
| Potassium bromide | 27.4 g |
| Potassium iodide | 3.3 g |
| Deionized water | 275.0 g |
| Silver nitrate | 42.5 g |
| Deionized water | 364.0 g |

The pAg was held at a constant value by means of a pAg feedback control loop described in Research Disclosure No. 17643; U.S. Pat. Nos. 3,415,650; 3,782,954; and 3,821,002.

The following two aqueous potassium salt and silver nitrate solutions were then jetted into this solution over a 28.5 minutes time interval.

| | |
|---|---|
| Potassium bromide | 179.0 g |
| Potassium iridium hexachloride | 0.010 g |
| Deionized water | 812.0 g |
| Silver nitrate | 127.0 g |
| Deionized water | 1090.0 g |

The emulsion was washed with water and then desalted. The average grain size was 0.05 μm as determined by Scanning Electron Microscopy (SEM).

Preparation of Iridium-Doped Pre-formed Silver Halide/Silver Organic Salt Dispersion:

A silver halide/silver organic salt dispersion was prepared as described below. This material is also referred to as a silver soap dispersion or emulsion.

| | |
|---|---|
| Humko Type 9718 fatty acid (available from Witco. Co., Memphis, TN) | 118.0 g |
| Humko type 9022 fatty acid (available from Witco. Co., Memphis, TN) | 570.0 g |
| Sodium Hydroxide (1.4863 m/l) | 1.5 L |
| Nitric acid (19 mL Conc. Nitric acid in 50 mL water) | 69 mL |
| Iridium-doped preformed core shell emulsion (700 g/mole in 1.25 liters of water) | 0.10 mol |
| Silver Nitrate (0.859 m/l) | 2.5 L |

The fatty acids were dissolved at 80° C. in 13 liters of water and mixed for 15 minutes. A dispersion was then formed by the addition of the sodium hydroxide with mixing for 5 minutes. After the addition of the nitric acid solution, the dispersion was cooled to 55° C. and stirred for 25 minutes. While maintaining at 55° C. the iridium-doped preformed core shell emulsion was added and mixed for 5 minutes, followed by the addition of the silver nitrate solution and mixed for an additional 10 minutes. The dispersion was washed with water until the wash water had a resistivity of 20,000 ohm/cm$^2$. The dispersion was then dried at 45° C. for 72 hours.

Homogenization of Pre-formed Soaps (Homogenate):

A pre-formed silver fatty acid salt homogenate was prepared by homogenizing the following ingredients:

| | |
|---|---|
| Methyl ethyl ketone | 77.0 g |
| Butvar ™ B-79 | 2.2 g |
| Iridium-doped preformed silver salt dispersion* | 20.8 g |

*The pre-formed silver soap contained 2.0% by weight of a 0.05 micron diameter core-shell silver iodobromide (25% core containing 8% iodide, 92% bromide, and 75% all-bromide shell) emulsion.

The ingredients above were mixed at 21° C. for 10 minutes and held for 24 hours. The mixture was homogenized at 4000 psi and then again at 8000 psi.

| Photothermographic silver emulsion coating solution: | |
|---|---|
| Homogenate | 85.80 g |
| Methyl ethyl ketone | 4.18 g |
| Pyridinium hydrobromide perbromide (26% by weight in methanol) | 0.48 g |
| Calcium bromide (15% by weight in methanol) | 0.64 g |
| 2-Mercapto-5-methylbenzimidazole | 0.06 g |
| 2-(3-Chlorobenzolyl) benzoic acid | 0.66 g |
| Dye-1 | 0.012 g |
| Methanol | 4.31 g |
| Butvar ™ B-79 | 21.45 g |
| 2-(Tribromomethylsulfonyl)quinoline (8% by weight in MEK) | 6.41 g |
| Permanax WSO | 4.93 g |
| Desmodur ™ N3300 triisocyanate (66.7% by weight in MEK) | 0.39 g |
| Tetrachlorophthalic acid (26% by weight in MEK) | 0.63 g |
| Phthalazine (22% by weight in MEK) | 2.22 g |
| Butvar ™ B-79 | 0.16 g |
| PE-2200 (30% by weight in MEK) | 3.76 g |

The first two ingredients listed above were mixed at 21° C. for 60 minutes. Calcium bromide was added and the mixture was allowed to stir an additional 30 minutes, followed by the addition of the 2-mercapto-5-methylbenzimidazole, 2-(3-chlorobenzolyl)benzoic acid, Dye-1 and methanol. After mixing 30 minutes, the dispersion was cooled to 10° C. The Butvar™ B-79 and 2-(tribromomethylsulfonyl)quinoline were then added and the dispersion mixed for 30 minutes. Each of the remaining ingredients are added individually with 15 minute mixing intervals.

EXAMPLES 1–4

Examples 1–4 illustrate the effects of different types of particulates in the backside and topcoat formulations on the transportability and haze of the corresponding photothermographic element.

Topcoat Coating Solutions:

The following ingredients were sequentially added and mixed to provide the representative topcoat coating solutions:

| Ingredients | Sol. A | Sol. B | Sol. C | Sol. D |
|---|---|---|---|---|
| CAB 171-15S (cellulose acetate butyrate; | 948.0 kg | — | — | 832.0 g |

-continued

| Ingredients | Sol. A | Sol. B | Sol. C | Sol. D |
|---|---|---|---|---|
| 6.1% by weight in MEK) | | | | |
| Acryloid ™ A-21 (acrylic copolymer; 10.6% by weight in MEK) | — | 470.0 g | 471.0 g | — |
| Super-Plex 200 (calcium carbonate, available from Speciality Minerals Inc.)* | 29.0 g | 32.0 g | — | — |
| Slip-Ayd ™ SL 530 (polyethylene wax, available from Daniel Products) | — | — | 380.0 g | 352.0 g |
| Methyl ethyl ketone | 6.68 kg | 6.67 kg | 7.02 kg | 5.66 kg |
| Methanol | 1.00 kg | 1.03 kg | 980.0 g | 970.0 g |
| CAB 171-15S (cellulose acetate butyrate, available from Eastman Kodak) | 1.15 kg | 1.29 kg | 1.23 kg | 1.12 kg |
| Acryloid ™ A21 (acrylic copolymer, available from Rohm & Haas) | 46.0 g | — | — | 46.0 g |
| 4-Methylphthalic acid | 46.0 g | 49.0 g | 46.0 g | 45.0 g |
| Tetrachlorophthalic anhydride | 11.0 g | — | 11.0 g | 11.0 g |
| Vinyl sulfone | — | 17.0 g | — | — |
| Polymeric fluorinated surfactant A (16% by weight in MEK) | 84.0 g | 90.0 g | 85.0 g | 82.0 g |

*The calcium carbonate was high shear mixed with the cellulose acetate butyrate or Acryloid ™ resin MEK solutions before adding to the rest of the mixture. A mixing device such as Junke and Kunkel Ultra-Turrax Model SA-45 may be used.

Photothermographic elements were prepared by dual coating the photothermographic silver emulsion coating solution with each of the topcoat solutions A, B, C, and D on 7 mil (0.18 mm) polyester which had been previously coated with the representative backside coating described below and referenced in Table 1. The coatings were dried for 3 minutes at 82° C. (180° F.), giving rise to a 21.2 g/m$^2$ (2 g/ft$^2$) dry coating weight for the photothermographic silver emulsion and 2.7 g/m$^2$ (0.25 g/ft$^2$) dry coating weight for the topcoat.

The following backside coating solutions were used for Examples 1–4. The backside coatings were extrustion coated onto 7 mil (0.18 mm) polyester and air dried at 90° C. for 2 minutes, giving rise to a dry coating weight of 4.3 g/m$^2$ (0.40 g/ft$^2$).

| | Backside Coating Solutions: | | | |
|---|---|---|---|---|
| Ingredients | Ex. 1 | Ex. 2 | Ex. 3 | Ex. 4 |
| CAB 381-20 (cellulose acetate butyrate, available from Eastman Kodak: 12.7% by weight in MEK) | 8250 g | 8250 g | 8250 g | 8250 g |
| PE 2200 (polyester resin, available from Shell; 2.9% by weight in MEK) | 515.0 g | 515.0 g | 515.0 g | 515.0 g |
| Antihalation Dye-2 (1.05% by weight in methanol) | 1051 g | 1051 g | 1051 g | 1051 g |
| Antislat L | 167.0 g | 167.0 g | 0.90 g | 167.0 g |
| 74-X6000 Syloid (4 micron silica, available from W. R. Grace) | 6.4 g | — | — | — |
| Polystyrene methacrylate beads (7 micron average size) | — | 6.8 g | 14.0 g | 14.0 g |
| Polymethylmethacrylate beads (13 micron average size) | — | — | 42.0 g | — |

The films described above were tested for their separation characteristics by running a practical test in a sheet feeding apparatus equipped with a suction feed mechanism as described in U.S. Pat. No. 5,181,707. Sheets were run through the sheet feeding apparatus with an observer evaluating the ease of transportation of the films in the apparatus. The observer rated the film performance on a scale of 1 to 10 with 10 being the best and 1 being the worst. A rating of 6 or above is considered acceptable and below 6 is considered unacceptable.

The haze level of the backside coating was measured for each example using a Gardner Haze Meter XL-211 Model 8011. The coefficient of friction of the backside coating was measured using an Instrumentors Inc. Slip/Peel tester Model 3M90. The smoothness of the backside coating surface was measured using a BEKK smoothness and porosity tester Model No. BK-131/ED.

Table 1 summarizes compares the effect of different types of particulates in the backside coatings of the photothermographic elements when a polymeric fluorinated surfactant is used in the topcoat.

TABLE 1

| Backside Solution | Topcoat Solution | Transport Rating | Haze | Coefficient of Friction | BEKK Smoothness |
|---|---|---|---|---|---|
| Example 1 | A | 2 | 4.1 | 0.27 | 124.4 |
| Example 2 | A | 8 | 3.6 | 0.26 | 35.4 |
| Example 3 | B | 8.5 | 9.9 | 0.51 | 1.8 |
| Example 4 | C | 6 | 4.8 | 0.34 | 47.2 |
| Example 1 | D | 4 | 4.3 | 0.30 | 228.2 |

The coefficient of friction does not appear to be a good indicator for the transportability of photothermographic elements in an automated apparatus. The BEKK smoothness gives a better indication, where the lower the reading corresponds to less element transport failures. The transport ratings clearly show that the optically transparent beads improve the transport of the elements. Examples 1A and 1D using silica to provide slip gave unacceptable results in the transport evaluation, where Examples 2A, 3B, and 4C using polymethyl methacrylate and polystyrene methacrylate beads gave acceptable ratings. Even though Example 3B is better for transportability, the haze level is worse than the other examples. A haze value of 9.9 is not the most preferred level, however under some conditions it would be acceptable.

EXAMPLE 5

Example 5 illustrates the relationship between the incorporation of the polymeric fluorinated surfactant in the topcoat and the optically transparent polymeric beads in the backside coating.

Topcoat Coating Solutions:

The following ingredients were sequentially added and mixed to provide a stock topcoat mating solution:

| Ingredients | |
|---|---|
| Acryloid ™ A-21 (acrylic copolymer 10.6% by weight in MEK) | 448.0 g |
| Super-Plex 200 (calcium carbonate, available from Speciality Minerals Inc.)* | 30.0 g |
| Methyl ethyl ketone | 7.13 kg |
| Methanol | 990.0 g |
| CAB 171-15S (cellulose acetate butyrate, available from Eastman Kodak Co.) | 1.25 kg |
| 4-Methylphthalic acid | 47.0 g |
| Tetrachlorophthalic anhydride | 11.0 g |

*The calcium carbonate was high shear mixed with the Acryloid ™ resin MEK solution before adding to the rest of the mixture. A mixing device such as Junke and Kunkel Ultra-Turrax Model SA-45 may be used.

The photothermographic silver emulsion coating solution, described earlier, was dual coated with topcoat solutions containing varying levels of polymeric fluorinated surfactant A added to the above stock solution, onto 7 mil (0.18 mm) polyester coated with the backside coating described in Example 4. The coatings were dried for 3 minutes at 82° C. (180° F.), giving rise to a 21.2 g/m$^2$ (2 g/ft$^2$) dry coating weight for the photothermographic silver emulsion and 2.7 g/m$^2$ (0.25 g/ft$^2$) dry coating weight for the topcoat.

Table 2 summarizes the coating mottle observed and the transportability of the photothermographic elements. The coating mottle was evaluated by exposing the photothermographic element to light followed by thermally processing the element at 124° C. (255° F.) for 15 seconds to produce a uniform optical density between 1.5 and 2.0. The photothermographic elements were then viewed on a lightbox and compared with a set of visual standards rating coating mottle between 1 and 10. A rating of 6 is considered to be the minimum required to be acceptable. The transportability was evaluated the same as in Examples 1–4.

TABLE 2

| % by wgt. Polymeric fluorinated surfactant A | Mottle Rating | Transport Rating | Haze | Coefficient of Friction | BEKK Smoothness |
|---|---|---|---|---|---|
| 0% | 5 | 10 | 5.9 | 0.55 | 34.3 |
| 0.33% | 5 | 5 | 6.8 | 0.56 | 36.1 |
| 0.67% | 5 | 6 | 5.1 | 0.62 | 55.2 |
| 1% | 6 | 9 | 6.5 | 0.24 | 21.5 |

The uniformity of the coating improved with the increased concentration of the polymeric fluorinated surfactant. Again, the coefficient of friction does not appear to be a good indicator of the transportability of the elements in the automated apparatus. With the incorporation of the optically transparent beads in the backside coating, acceptable transportability can be achieved even at the higher concentrations of the polymeric fluorinated surfactant.

Reasonable variations and modifications are possible from the foregoing disclosure without departing from either the spirit or scope of the present invention as defined in the claims.

What is claimed is:

1. A photothermographic element comprising a support having coated thereon:

(a) a photothermographic emulsion layer comprising a photosensitive silver halide, a non-photosensitive reducible source of silver, a reducing agent for silver ion and a binder;

(b) a layer adjacent to said photothermographic silver emulsion layer comprising a binder and a polymeric fluorinated surfactant; and (c) an outermost layer which is not removed during imaging of said photothermographic element and which is positioned on the side of said support opposite from said photothermographic emulsion layer, said outermost layer consisting essentially of a plurality of optically transparent organic polymeric beads.

2. The element of claim 1 wherein said polymeric fluorinated surfactant comprises at least three different groups within the polymer chain derived from reactive monomers, said monomers comprising:

(a) a fluorinated, ethylenically unsaturated monomer;

(b) a hydroxyl-containing, ethylenically unsaturated monomer; and (c) a polar, ethylenically unsaturated monomer.

3. The element of claim 1 wherein said optically transparent organic polymeric beads comprise a polymethyl methacrylate or polystrene methacrylate polymer.

4. A thermographic element comprising a support having coated thereon:

(a) a thermographic emulsion layer comprising a non-photosensitive reducible source of silver, a reducing agent for silver ion, and a binder;

(b) a layer adjacent to said thermographic emulsion layer comprising a binder and a polymeric fluorinated surfactant; and (c) an outermost layer which is not removed during development of said thermographic element and which is positioned on the side of said support opposite from said thermographic emulsion layer, said outermost layer consisting essentially of a plurality of optically transparent organic polymeric beads.

5. The element of claim 4 wherein said polymeric fluorinated surfactant comprises at least three different groups within the polymer chain derived from reactive monomers, said monomers comprising:

(a) a fluorinated, ethylenically unsaturated monomer;

(b) a hydroxyl-containing, ethylenically unsaturated monomer; and (c) a polar, ethylenically unsaturated monomer.

6. The element of claim 4 wherein said optically transparent organic polymeric beads comprise a polymethyl methacrylate or polystrene methacrylate polymer.

* * * * *